US009259746B2

(12) United States Patent
Marino

(10) Patent No.: US 9,259,746 B2
(45) **Date of Patent: *Feb. 16, 2016**

(54) ADJUSTABLE SMOOTH BORE NOZZLE

(71) Applicant: WaterShield LLC, Englewood, CO (US)

(72) Inventor: Robert M. Marino, Springdale, AR (US)

(73) Assignee: WaterShield LLC, Englewood, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/536,865

(22) Filed: Nov. 10, 2014

(65) Prior Publication Data

US 2015/0060571 A1 Mar. 5, 2015

Related U.S. Application Data

(63) Continuation of application No. 13/186,884, filed on Jul. 20, 2011, now Pat. No. 8,882,002, which is a continuation of application No. 12/172,249, filed on Jul. 13, 2008, now Pat. No. 8,002,201, which is a (Continued)

(51) Int. Cl.

| | |
|---|---|
| ***B05B 1/30*** | (2006.01) |
| ***B05B 1/12*** | (2006.01) |
| ***B05B 1/28*** | (2006.01) |
| ***A62C 31/03*** | (2006.01) |

(52) U.S. Cl.

CPC . *B05B 1/30* (2013.01); *A62C 31/03* (2013.01); *B05B 1/12* (2013.01); *B05B 1/28* (2013.01); *B05B 1/3026* (2013.01); *B05B 1/3073* (2013.01); *Y10T 137/7904* (2015.04)

(58) Field of Classification Search

CPC ..... B05B 1/30; B05B 1/3026
USPC ..... 239/455, 435, 539, 590, 546, 365.43
See application file for complete search history.

(56) References Cited

U.S. PATENT DOCUMENTS

| | | | | |
|---|---|---|---|---|
| 22,819 | A * | 2/1859 | Parrott et al. | 239/452 |
| 157,526 | A | 12/1874 | Leggett | |
| 157,527 | A | 12/1874 | Leggett | |
| 186,310 | A | 1/1877 | Curtis | |
| 351,968 | A | 11/1886 | Derrick | |
| 583,135 | A | 5/1897 | Wilson | |
| 584,197 | A | 6/1897 | Snider | |
| 603,144 | A | 4/1898 | Kellerman et al. | |

(Continued)

OTHER PUBLICATIONS

"Sabert Jet Nozzles," Akron Brass Company, Internet advertisement at http://www.akronbrass.com/products/saberjet.htm, 2001, 3 pages.

(Continued)

*Primary Examiner* — Len Tran
*Assistant Examiner* — Cody Lieuwen
(74) *Attorney, Agent, or Firm* — Sheridan Ross P.C.

(57) ABSTRACT

An adjustable nozzle comprising a nozzle body with an inlet, an outlet and a flow chamber having a smooth bore extending between the inlet and the outlet. An elastic water impervious material is in fluid communication with the inlet and is tapered and is able to expand due to its elasticity. An adjustable non-rusting member connected to the nozzle body expands or constricts to either increase or decrease the inner diameter of the nozzle body to adjust the flow rate through the nozzle.

20 Claims, 15 Drawing Sheets

Related U.S. Application Data continuation of application No. 11/456,839, filed on Jul. 11, 2006, now abandoned, which is a continuation of application No. 10/306,273, filed on Nov. 27, 2002, now Pat. No. 7,097,120.

(60) Provisional application No. 60/334,376, filed on Nov. 29, 2001, provisional application No. 60/338,609, filed on Dec. 5, 2001, provisional application No. 60/338,612, filed on Dec. 5, 2001, provisional application No. 60/338,787, filed on Dec. 5, 2001, provisional application No. 60/339,526, filed on Dec. 7, 2001, provisional application No. 60/346,452, filed on Jan. 4, 2002, provisional application No. 60/346,320, filed on Jan. 4, 2002.

(56) References Cited

U.S. PATENT DOCUMENTS

| | | | | |
|---|---|---|---|---|
| 690,754 | A | 1/1902 | McKechney | |
| 692,571 | A | 2/1902 | Wieman | |
| 721,665 | A | 3/1903 | Busha | |
| 851,603 | A | 4/1907 | Long | |
| 930,095 | A | 8/1909 | Seagrave | |
| 1,004,770 | A | 10/1911 | Galloway et al. | |
| 1,040,899 | A | 10/1912 | Dahmen | |
| 1,072,951 | A | 9/1913 | Johnston | |
| 1,132,935 | A | 3/1915 | Hopkins | |
| 1,823,277 | A | 9/1931 | Lum | |
| 1,865,012 | A | 6/1932 | Jackson | |
| 1,893,298 | A | 1/1933 | Moore | |
| 2,176,699 | A | 10/1939 | Anderson | |
| 2,271,800 | A | 2/1942 | Meussdorffer | |
| 2,303,992 | A | 12/1942 | Frazer et al. | |
| 2,331,741 | A | 10/1943 | Smith | |
| 2,389,642 | A | 11/1945 | Schellin et al. | |
| 2,567,176 | A | 9/1951 | Ballard | |
| 2,569,996 | A | 10/1951 | Kollsman | |
| 2,585,509 | A | 2/1952 | Smith | |
| 2,959,359 | A | 11/1960 | Casaletto | |
| 2,991,016 | A | 7/1961 | Allenbaugh, Jr. | |
| 3,018,792 | A | 1/1962 | Brucker | |
| 3,163,363 | A | 12/1964 | Travis | |
| 3,204,664 | A | 9/1965 | Gorchev et al. | |
| 3,301,492 | A | 1/1967 | Kingsley | |
| 3,363,842 | A | 1/1968 | Burns | |
| 3,539,112 | A | 11/1970 | Thompson | |
| 3,647,002 | A | 3/1972 | Lindsay | |
| 3,684,192 | A | 8/1972 | McMillan | |
| 3,776,470 | A * | 12/1973 | Tsuchiya | B05B 1/32 239/265.43 |
| 3,837,362 | A | 9/1974 | Barnes | |
| 3,863,844 | A | 2/1975 | McMillan | |
| 3,895,646 | A | 7/1975 | Howat | |
| 4,172,559 | A | 10/1979 | Allenbaugh, Jr. | |
| 4,252,278 | A | 2/1981 | McMillan | |
| 4,289,277 | A | 9/1981 | Allenbaugh | |
| 4,342,426 | A | 8/1982 | Gagliardo | |
| 4,358,058 | A | 11/1982 | Bierman | |
| 4,383,550 | A | 5/1983 | Sotokazu | |
| 4,436,111 | A | 3/1984 | Gold et al. | |
| 4,589,439 | A | 5/1986 | Steingass | |
| 4,653,693 | A | 3/1987 | Steingass | |
| 4,770,212 | A | 9/1988 | Wienck | |
| 4,785,998 | A | 11/1988 | Takagi | |
| 4,789,104 | A | 12/1988 | Anderson | |
| 4,944,460 | A | 7/1990 | Steinglass et al. | |
| 4,982,897 | A | 1/1991 | Matusita et al. | |
| 5,039,014 | A | 8/1991 | Lippmeier | |
| 5,215,254 | A | 6/1993 | Haruch | |
| 5,261,494 | A | 11/1993 | McLoughlin et al. | |
| 5,312,048 | A | 5/1994 | Steingass et al. | |
| 5,390,696 | A | 2/1995 | Bird et al. | |
| 5,593,092 | A | 1/1997 | McMillan et al. | |
| 5,775,596 | A | 7/1998 | Whisman et al. | |
| 5,848,752 | A | 12/1998 | Kolacz et al. | |
| D414,243 | S | 9/1999 | Steingass et al. | |
| 5,964,410 | A | 10/1999 | Brown et al. | |
| 6,007,001 | A | 12/1999 | Hilton | |
| 6,039,269 | A | 3/2000 | Mandzukic | |
| 6,089,474 | A | 7/2000 | Marino | |
| 6,102,308 | A | 8/2000 | Steingass et al. | |
| 6,109,360 | A | 8/2000 | Mandzukic et al. | |
| 6,113,004 | A | 9/2000 | Steingass et al. | |
| 6,173,940 | B1 | 1/2001 | Kardohely et al. | |
| 6,305,621 | B1 | 10/2001 | Kolacz et al. | |
| 6,318,706 | B1 | 11/2001 | Montaz | |
| 6,354,320 | B1 | 3/2002 | Kolacz et al. | |
| 6,598,810 | B2 | 7/2003 | Lanteri | |
| 6,749,027 | B1 | 6/2004 | Crabtree et al. | |
| 7,097,120 | B2 * | 8/2006 | Marino | 239/539 |
| 7,258,285 | B1 | 8/2007 | Combs et al. | |
| 7,445,166 | B2 | 11/2008 | Williams | |
| 7,971,800 | B2 | 7/2011 | Combs et al. | |
| 8,002,201 | B2 * | 8/2011 | Marino | 239/11 |
| 8,006,923 | B2 | 8/2011 | Stoops | |
| 8,882,002 | B2 * | 11/2014 | Marino | 239/455 |
| 9,010,664 | B2 | 4/2015 | Combs et al. | |
| 2005/0017095 | A1 | 1/2005 | Mehr | |
| 2007/0007367 | A1 | 1/2007 | Marino | |
| 2011/0204101 | A1 | 8/2011 | Jenkins | |

OTHER PUBLICATIONS

"What Goes Around . . . Comes Around . . . ," Task Force Tips, Sep. 4, 2001, 2 pages (Advertisement).
Official Action for U.S. Appl. No. 10/306,273, mailed Mar. 16, 2004.
Official Action for U.S. Appl. No. 10/306,273, mailed Oct. 26, 2004.
Official Action for U.S. Appl. No. 10/306,273, mailed May 6, 2005.
Official Action for U.S. Appl. No. 10/306,273, mailed Dec. 21, 2005.
Notice of Allowance for U.S. Appl. No. 10/306,273, mailed Mar. 13, 2006.
Restriction Requirement for U.S. Appl. No. 11/456,839, mailed Jul. 21, 2008.
Official Action for U.S. Appl. No. 11/456,839, mailed Nov. 14, 2008.
Restriction Requirement for U.S. Appl. No. 12/172,249, mailed Jul. 22, 2010.
Official Action for U.S. Appl. No. 12/172,249, mailed Oct. 14, 2010.
Official Action for U.S. Appl. No. 12/172,249, mailed Mar. 3, 2011.
Notice of Allowance for U.S. Appl. No. 12/172,249, mailed Apr. 11, 2011.
Official Action for U.S. Appl. No. 13/186,884 mailed Feb. 4, 2013, 10 pages.
Official Action for U.S. Appl. No. 13/186,884 mailed Jul. 5, 2013, 7 pages.
Official Action for U.S. Appl. No. 13/186,884 mailed Nov. 22, 2013, 7 pages.
Notice of Allowance for U.S. Appl. No. 13/186,884 mailed Jul. 8, 2014, 7 pages.

* cited by examiner

ADJUSTABLE SMOOTH BORE NOZZLE

CROSS-REFERENCE TO RELATED APPLICATIONS

This application is a continuation of U.S. patent application Ser. No. 13/186,884, filed on Jul. 20, 2011 (now U.S. Pat. No. 8,882,002), which is a continuation of U.S. patent application Ser. No. 12/172,249, filed on Jul. 13, 2008 (now U.S. Pat. No. 8,002,201), which is a continuation of U.S. patent application Ser. No. 11/456,839, filed on Jul. 11, 2006 (abandoned), which is a continuation application of U.S. patent application Ser. No. 10/306,273, filed on Nov. 27, 2002 (now U.S. Pat. No. 7,097,120), which claimed the benefit of U.S. Provisional Patent Application No. 60/334,376 filed on Nov. 29, 2001 entitled "HOSE NOZZLE APPARATUS AND METHOD"; U.S. Provisional Patent Application No. 60/338,609 filed on Dec. 5, 2001 entitled "HOSE NOZZLE APPARATUS AND METHOD"; U.S. Provisional Patent Application No. 60/338,612 filed on Dec. 5, 2001 entitled "METERING VALVE"; U.S. Provisional Patent Application No. 60/338,787 filed on Dec. 5, 2001 entitled "HOSE NOZZLE APPARATUS AND METHOD"; U.S. Provisional Patent Application No. 60/339,526 filed on Dec. 7, 2001 entitled "HOSE NOZZLE APPARATUS AND METHOD"; U.S. Provisional Patent Application No. 60/346,452 filed on Jan. 4, 2002 entitled "SMOOTH BORE HOSE NOZZLE APPARATUS AND METHOD"; and U.S. Provisional Patent Application No. 60/346,320 filed on Jan. 4, 2002 entitled "HOSE NOZZLE APPARATUS AND METHOD"; all of which are incorporated herein by reference in their entirety.

FIELD OF THE INVENTION

This invention relates to a hose nozzle apparatus and method for controlling and adjusting the flow of a liquid stream at a nozzle using manually adjustable flow controls to adjust the flow rates of two types of available flows from a single nozzle. Although presented herein to focus on fire fighting equipment, the present invention may be used where ever nozzles are utilized to apply a fluid. With regard to fire fighting equipment, this invention relates to a fire fighting hose nozzle apparatus and method for providing a deluge stream, a fog spray, or both to a fire at manually adjustable flow rates.

BACKGROUND OF THE INVENTION

Fire hose nozzles are used by fire fighters for supplying water or other liquids to extinguish fires. A common method of extinguishing fires is to direct a flow of liquid, usually water, onto the fire and often the surrounding area. The flow rate may have to be reduced, or increased, depending on the changing character of the fire. The flow is typically delivered in a deluge, also known as a smooth bore flow, or in a fog spray. Typically two separate nozzles are required to achieve these distinct flow types. The deluge provides a straight and solid stream, with maximum reach and penetration. A deluge can be delivered in a relatively precise area thus providing a maximum amount of water into a specific location. The fog spray provides a pattern which can be a straight, aspirated spray, or a wide, aspirated spray with less reach and penetration than a deluge at equivalent supply pressure.

Fire fighters may use the fog to cover a wider area and without the force of a deluge which might scatter burning materials before they are extinguished, thus spreading a fire. They may also use the spray in a very wide pattern to create a shield from the intense heat of a fire. The wide fog pattern also creates a back draft which brings cooler, cleaner air from behind the fire fighter. A wide fog will more quickly lower the heat of a fire by flashing into steam.

Fire fighters may ideally need both flow types for the same fire and may prefer to move from deluge to fog and back. To accomplish this, it has traditionally been necessary to stop the flow and change nozzles.

Certain nozzles in the prior art, hereinafter referred to as combination nozzles, include both a deluge and a spray. Combination nozzles of the prior art were intended to overcome the limitations of having to change single nozzles or use two different hoses simultaneously when two patterns were needed. However, combination nozzles of the prior art have several drawbacks. Most combination nozzles of the prior art have a fixed fog pattern around a fixed deluge. They cannot produce a straight fog spray, nor can the fog and deluge operate independently of each other. The most critical drawback affects all combinations of the prior art. They are simply two nozzles stuck together. Due to the limitations of this design, when the second nozzle is enabled after the first nozzle is flowing, the pressure to the nozzle instantly decreases to a level which significantly and negatively impacts the reach and stream quality of the nozzle. This dangerous condition for the nozzle operator can only be addressed by the pump operator. However, communication between the pump operator and the nozzle operator is not reliable during an emergency, and therefore, this dangerous situation can exist for long periods. Coordination between the pump operator and nozzle operator is further complicated by the presence of multiple nozzle operators connected to a common pump each capable of changing the hydraulic conditions the pump operator must overcome. Additionally, when one nozzle is shut down after both nozzles have successfully been adjusted for simultaneous operation, the result is a sudden and unwelcome rise in pressure that increases the nozzle reaction. This is a force the nozzle operator must combat to hold on to the nozzle. This too is a dangerous situation that must be addressed by the pump operator with the aforementioned communication and coordination difficulties.

Thus there exists a need for an apparatus and method which permits quick, efficient and convenient operation of a fire hose nozzle in deluge mode, fog mode, or both. Furthermore, it would be desirable for the fire fighter to be able to adjust the flow rates such that the flow rates can be reduced or increased to balance flow between the deluge and fog modes, thereby avoiding the previously described "dangerous conditions." The invention described herein provides such a nozzle.

SUMMARY OF THE INVENTION

The present invention offers the fire fighter the capability to apply a deluge stream in combination with a fog spray at the same time. Furthermore, the present invention allows the fire fighter to independently enable the deluge stream and the fog spray, plus adjust the total combined discharge, thereby regulating the pressure to maintain safe operation. Therefore, the present invention offers manual adjustment of two kinds of flow from the same nozzle. Accordingly, it is an aspect of the present invention to provide an apparatus and method for delivering two liquid streams for fire fighting where the flows are selectively variable.

It is a further aspect of the present invention to provide an apparatus and method for manually maintaining the flow of a liquid stream as pressure changes, or maintaining adequate and safe operating pressure by changing the total flow should it be necessary to do so.

It is a further aspect of the present invention to provide an apparatus and method for selectively varying the flow of a liquid stream and manually maintaining the selected flow as pressure changes.

It is a further aspect of the present invention to provide an apparatus and method for delivering two liquid streams for fire fighting.

It is a further aspect of the present invention to provide an apparatus and method for delivering either one or both of two liquid streams for fire fighting.

It is a further aspect of the present invention to provide an apparatus and method for delivering either one or both of two liquid streams for fire fighting where the flows are selectively variable and manually maintaining the flows as the pressure changes, or maintaining adequate and safe operating pressure by changing the total flow should it be necessary to do so.

It is a further aspect of the present invention to provide an apparatus and method for delivering two liquid streams for fire fighting, where a first stream is aspirated with air and the second stream is not aspirated with air.

It is a further aspect of the present invention to provide an apparatus and method for delivering either one or both of two liquid streams for fire fighting where an outer aspirated stream is coaxial with an inner stream.

It is a further aspect of the present invention to provide an apparatus and method for delivering either one or both of two liquid streams for fire fighting, where a first stream is aspirated with air and may be varied from a narrow to a wide flow pattern.

It is a further aspect of the present invention to provide an apparatus and method for delivering either one or both of two liquid streams for fire fighting, where a first stream is aspirated with air and may be varied from a narrow to a wide flow pattern, and where foreign materials may be flushed from the system with the first stream in a flush setting while the second stream remains functional.

It is a further aspect of the present invention to provide an apparatus and method for delivering two liquid streams for fire fighting, where a first stream is aspirated with air and is outwardly coaxial with an inner stream which is not aspirated with air.

It is a further aspect of the present invention to provide an apparatus and method for delivering two coaxial liquid streams for fire fighting, where a first stream is aspirated with air and is outwardly coaxial with an inner stream which is not aspirated with air and where air moves between the two streams.

It is a further aspect of the present invention to provide an apparatus and method for delivering either one or both of two liquid streams for fire fighting where an outer aspirated stream is coaxial with an inner stream, and where the axial distance between the inner stream and the outer stream decreases as the flows move outwardly from the apparatus.

It is a further aspect of the present invention to provide an apparatus and method for delivering two coaxial liquid streams for fire fighting, where a first stream is aspirated with air and is outwardly coaxial with an inner stream which is not aspirated with air, where the axial distance between the inner stream and the outer stream decreases as the flows move outwardly from the apparatus, where air moves between the two streams at a lower pressure than air outside the outer stream, and where the two streams are made more compact and aerodynamic by the lower pressure air moving between the two streams, thus increasing the distance the streams may travel to allow the fire fights to remain at a safer distance.

It is a further aspect of the present invention to provide an apparatus and method for delivering either one or both of two liquid streams for fire fighting, which are efficient and economical.

It is a further aspect of the present invention to provide an apparatus and method to provide a simple, quick and effective means to regulate the amount of flow, and thereby address changing fire conditions and immediately compensate for pressure changes up-line.

It is a further aspect of the present invention to provide an apparatus and method to provide a smooth shut off and turn on feature to avoid water hammering.

It is a further aspect of the present invention to provide an apparatus and method to provide a means of selectively supplying a fog spray which produces fine water droplets or larger water droplets.

The foregoing objects are accomplished in a preferred embodiment of the invention by a combination nozzle having a valve, a throttle, a smooth bore nozzle and an aspirated nozzle. The valve opens or closes the smooth bore nozzle. The throttle valve opens or closes the aspirated nozzle. Also, the throttle valve may be positioned to vary the flow rate. The flows from the smooth bore nozzle and the aspirated nozzle may be operated individually or together, and in varying sequences. Therefore, a deluge stream may be provided alone or in combination with fog spray, and fog spray may be applied alone or in combination with a deluge stream. As pressure changes in the water supply, the present invention allows the firefighter to manually adjust the fog spray throttle valve, thereby directly adjusting the fog spray flow, and indirectly adjusting the deluge stream flow. Specifically, by adjusting the fog spray throttle valve while the deluge stream flow is being applied, the deluge stream either receives more flow or less flow in inverse relation to the throttle position of the fog spray. For example, if the deluge stream is engaged, and the fog spray throttle slider valve is fully open, then the deluge stream is receiving the minimum available flow because the opening of the fog spray will decrease pressure to the nozzle. More flow will leave the fog tip despite the drop in pressure because the opening has been enlarged. The smooth bore opening remains constant but the pressure has dropped so the flow is less. Flow to the smooth bore will be restored if the pump operator adjusts the pump rate to build pressure back to the target pressure. Accordingly, one aspect of the present invention is to provide the firefighter with the means to quickly maintain safe operating pressure by adjusting the combined flow to be in optimum relationship with the available water supply (flow and pressure). Conversely, if the deluge stream is engaged but the fog spray throttle slider valve is fully closed or only barely opened, then the deluge stream will receive all or nearly all of the available flow, respectively. The present invention also allows the firefighter to quickly and easily adjust and regulate the flow using the manually adjustable slider throttle valve to compensate for changing fire conditions or pressure changes in the water supply source.

The present invention incorporates two flow paths, wherein a smooth bore provides a deluge stream flow and a second flow path provides a fog spray. The second flow path is located between the exterior of the smooth bore and the inner wall of the nozzle body. Therefore, the nozzle of the present invention advantageously provides an aspirated fog spray coaxial to a deluge stream when both flow paths are enabled. In addition, structural features of the nozzle allow the aspirated fog spray to be applied in a wide-angle spray or in a narrow-angle focused spray. Further structural features of the nozzle also allow the firefighter to manipulate the slider valve throttle control such that the second flow path can be opened wide or flushed to remove debris within the nozzle.

Further aspects of the present invention will be made apparent in the following Detailed Description of the Invention and the appended claims.

While the following disclosure describes the invention in connection with those embodiments presented, one should understand that the invention is not strictly limited to these embodiments. Furthermore, one should understand that the drawings are not necessarily to scale, and that in certain instances, the disclosure may not include details which are not necessary for an understanding of the present invention, such as conventional details of fabrication and assembly.

DETAILED DESCRIPTION OF THE INVENTION

Figure 1:
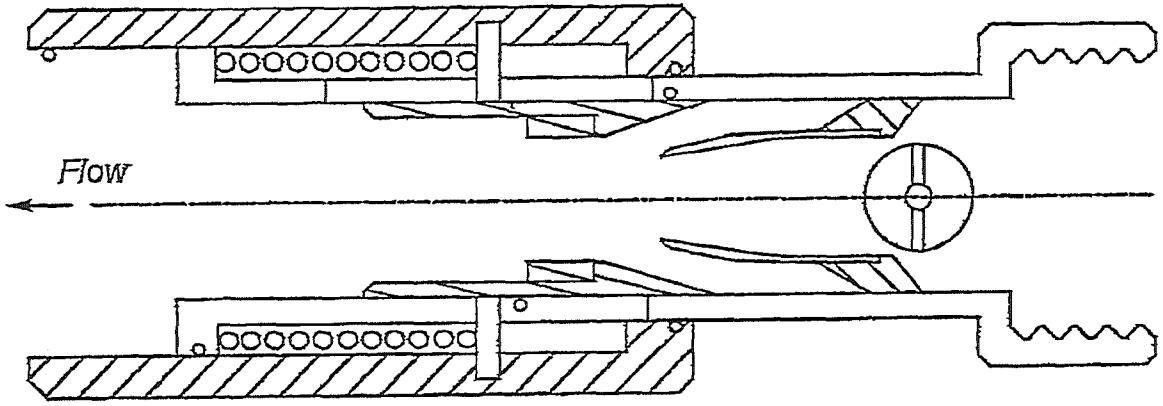
FIGS. 1-8*a* illustrate various views of different aspects and embodiments of a smooth bore barrel nozzle.

Water can flow through the small bore and large bore simultaneously (FIG. 1). The small bore is fixed and always open if the on/off valve (not shown) is on. The sliders proximately to the fixed, small bore form the large bore. This nozzle, like all smooth bores operates best at nozzle inlet pressure between 50 and 70-psi. I have selected 60 psi as the optimum inlet pressure for this nozzle. Therefore, the upstream profile (area in inches) of the slider times 60 psi equals the force of the pre-loaded spring acting upon the slider in a direction opposite the flow of water. The spring's left end is fixed, while its right end is allowed to move. This movement pushes against the pegs, which are positioned through slotted holes of the nozzle body and anchored into the slider. Further, the pegs ride in a spiral groove of the bell ID. When the bell is rotated counterclockwise (looking at the outlet end of the nozzle), the slider will move to the left and increase the area of water discharge. When the bell is rotated clockwise, the slider moves to the right and decreases the area of water discharge. This increases and decreases the GPM, respectively.

Figure 2:
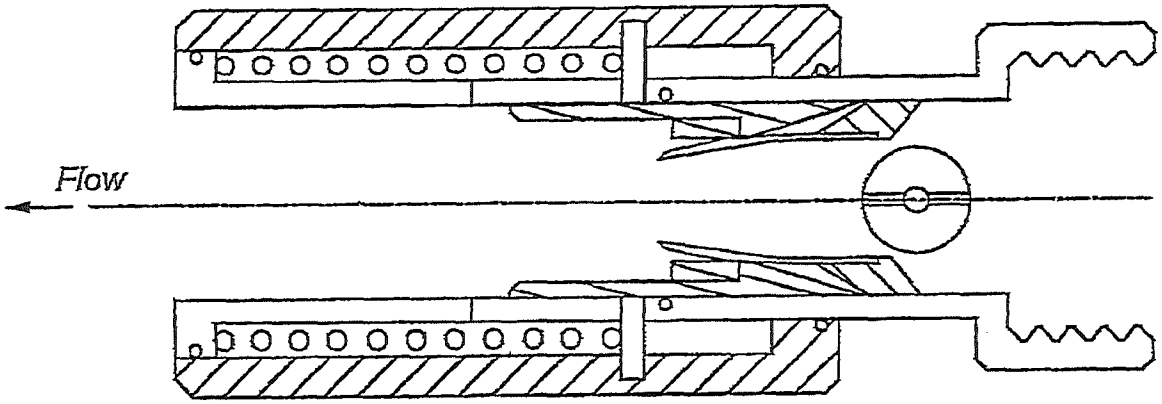

When the pump supplies the appropriate GPM, just the small bore will expel water (FIG. 2). A nozzle inlet pressure of 60 psi will also be achieved. Rotating the bell counterclockwise will be progressively more difficult it this situation B a good thing. This movement would increase the area of discharge. If this were done without changing the pump rate, the inlet pressure would drop. The lower pressure would no longer be in equilibrium with the opposite force exerted by the spring. Rotation of the bell will be difficult. Again, this is good since it will let the firefighter know that there is insufficient water supply to increase the area of discharge. The inadequacy of the supply would negatively impact reach and stream quality if the firefighter continues to increase the exit orifice.

As the pump rate is increased, the inlet pressure will begin to rise. This rise in pressure will allow the firefighter to easily rotate the bell counterclockwise and appropriately increase the exit orifice and therefore the GPM, while returning the inlet pressure to the target 60 psi.

The clutch is used when the firefighter wants to "flush" water-borne debris out of the nozzle. The clutch is ordinarily in the setting depicted in FIG. 2. The clutch is shaped like the fins of a dart. In the normal setting, the fins are aligned with the direction of flow. These fins create a wall affect in the center of the flow, which matches the wall affect of the ID of the small bore. The result is a column of water with more evenly matched velocity across the water column section. This uniformity of velocity improves the stream quality, as the expelled water tends to stay together and fragment less. When the firefighter turns the control knob (not shown) of the clutch 90 degrees, the fins are perpendicular to the flow. This blocks off the inlet to the small bore therefore minimizing the area of discharge. The decrease in exit orifice causes the inlet pressure to surge higher. This will allow the firefighter to easily turn the bell counterclockwise and allow the large bore to "flush" (the small bore is in continuous flush via its fixed design. Once finished, the firefighter returns the clutch to its normal position. The nozzle inlet pressure will now be lower than the target 60 psi and the firefighter can easily turn the bell clockwise, shutting off the large bore.

When more flow is desired, the firefighter communicates this desire to the pump operator. The increase in pump rate will increase the nozzle inlet pressure. The firefighter will then be able to easily rotate the bell counterclockwise to increase the GPM and return the nozzle inlet pressure to the target of 60 psi.

IV Automatic Smooth Bore:

The following description and drawings cover a smooth bore only nozzle.

Specifically, a smooth bore that automatically maintains desired nozzle inlet pressure as well as a means to increase/decrease GPM (when desired) without stopping and changing tips.

Figure 3:
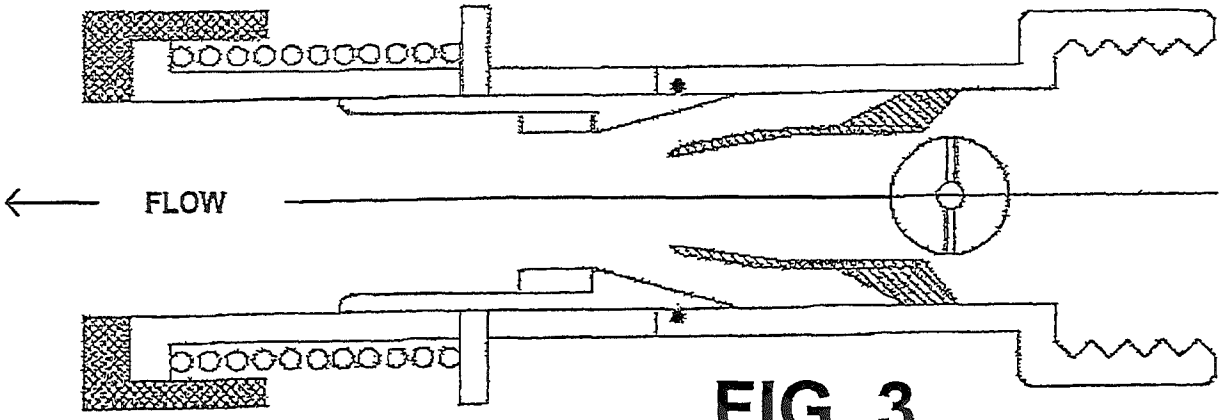

Description of the Figures:

Water can flow through the small bore and large bore simultaneously (FIG. 3). The small bore is fixed and always open if the on/off valve (not shown) is on. The sliders proximately to the fixed, small bore form the large bore. This nozzle, like all smooth bores operates best at nozzle inlet pressure between 50 and 70-psi. I have selected 60 psi as the optimum inlet pressure for this nozzle. Therefore, the upstream profile (area in inches) of the slider times 60 psi equals the force of the pre-loaded spring acting upon the slider in a direction opposite the flow of water. The spring=s left end is fixed, while its right end is allowed to move. This movement pushes against the pegs, which are positioned through slotted holes of the nozzle body and anchored into the slider. The bell has been removed. Now the slider can automatically respond to changes to pump rate. The response will come in the form of immediate equilibration and maintenance of the target nozzle inlet pressure of 60 psi.

Figure 4:
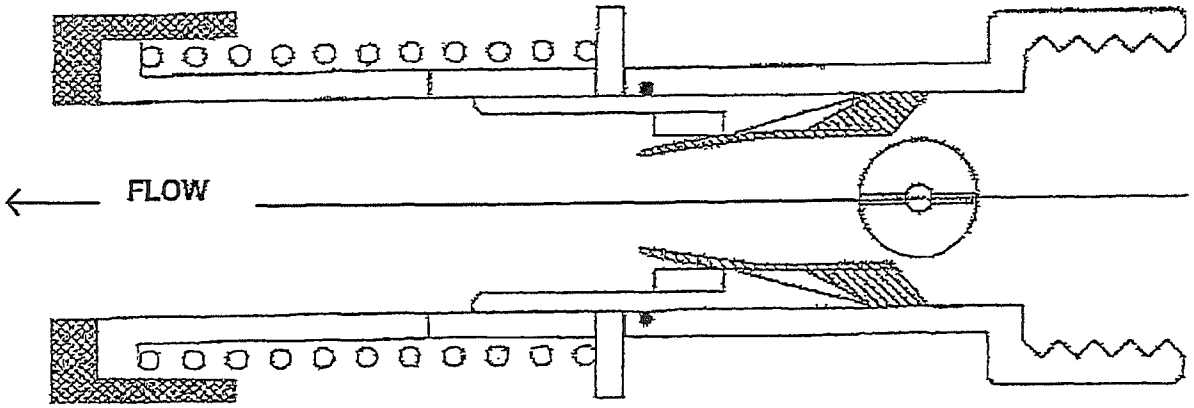

When the pump supplies the appropriate GPM, just the small bore will expel water (FIG. 4). A nozzle inlet pressure of 60 psi will also be achieved. An increase in pump rate will cause the slider to move to the left. This movement will increase the exit orifice thereby maintaining nozzle inlet pressure at 60 psi. If the pump rate decreases, the slider will automatically move to the right, decrease exit orifice and maintain target nozzle inlet pressure.

Operation of the clutch remains consistent with the Selectable Smooth Bore design.

Figure 5:
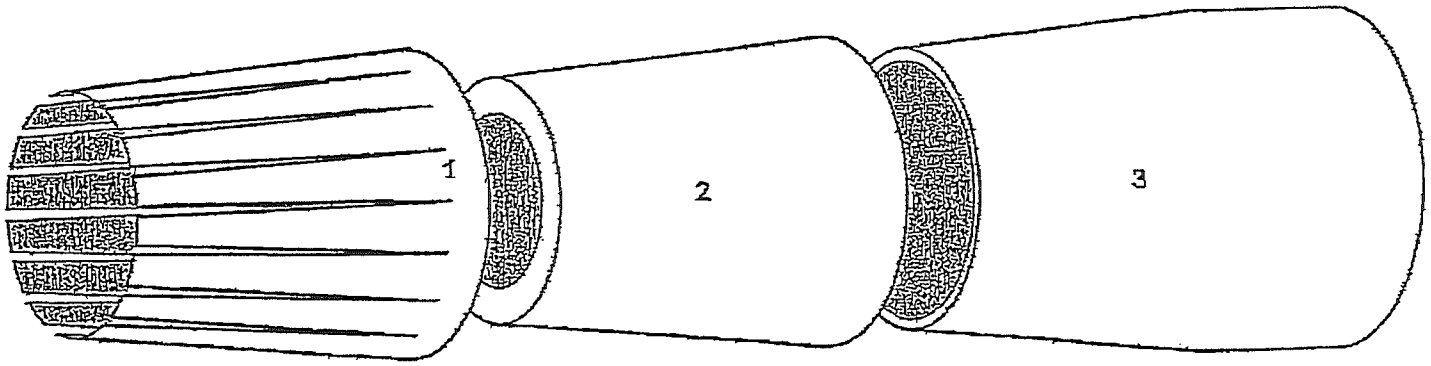

Alternate Selectable Smooth Bore and Automatic Smooth Bore:

The following are design(s) for an improved smooth bore fire nozzle that are useful for decreasing/increasing the GPM of the nozzle without altering the nozzle inlet pressure (FIG. 5). This constant pressure will minimize the change in nozzle reaction (force required to hold back the nozzle) vs. fixed exit area smooth bore nozzles when the GPM is varied. Furthermore, stream quality and reach will not be impacted as the GPM is varied.

Figure 5A:
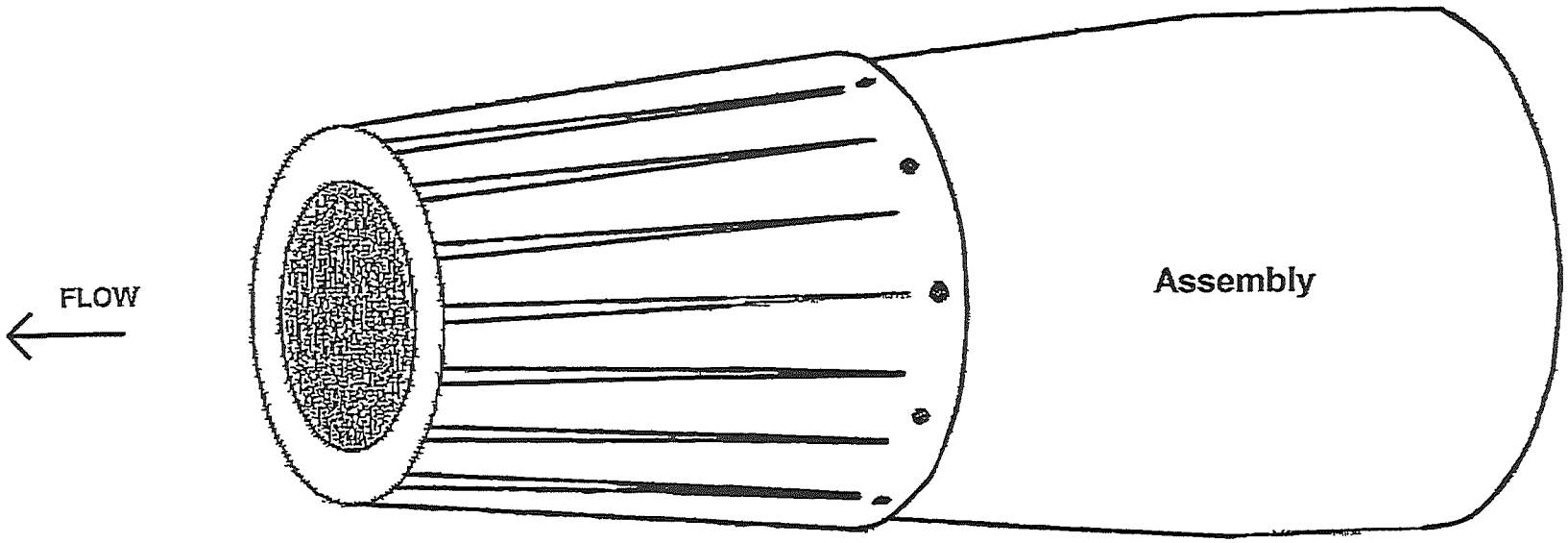

As depicted in FIG. 5, component 1 is a springy, non-rusting material such as stainless spring steel. It is tapered and has numerous, triangular sections cut horizontally from the left end. Component 2 is an elastic, water impervious material such as rubber and is also tapered. Its taper ideally matches that of 1, though this is not necessary. Component 3 is a rigid, non-rusting member suitably adapted on its right end (inlet end) for connection (usually threaded; not shown) to a hose (water supply). The outlet end of 3 is tapered to match and mate with 1 & 2. Component 1 is slipped over 2 and together they are riveted (or some other water-tight means of attachment) to 3. This then forms the throttle assembly. The assembled components are shown in FIG. 5*a*.

In this embodiment the nozzle will operate as an automatic smooth bore. The left end (outlet) of the assembly remains able to expand/constrict due to the ability of component 1 to increase/decrease its outlet diameter and the elasticity of component 2. For example, given a target nozzle inlet pressure of 60 psi, this nozzle will automatically expand/constrict its exit orifice area and equilibrates at this nozzle inlet pressure. An increase in GPM will cause the outlet to expand while a decrease in GPM will cause the outlet to constrict B both movements continuing until equilibrium is reached with a nozzle inlet pressure equal to 60 psi. This is achieved by matching the closing force of the assembly (additive forces of component 1's stainless spring steel plus the elasticity of component 2) with the opposing force caused by the nozzle inlet pressure, which has a tendency to increase the area of the exit orifice. Once this equilibrium is achieved the throttle is "matched". The force required for the outlet end to expand can be modified by many means, such as the wall thickness of components 1 and 2 and the individual properties of the selected materials. This will facilitate the matching process.

This smooth bore embodiment automatically maintains the desired nozzle inlet pressure as well as provides a manual means to increase/decrease GPM (when desired) without stopping and changing tips.

Figure 6:
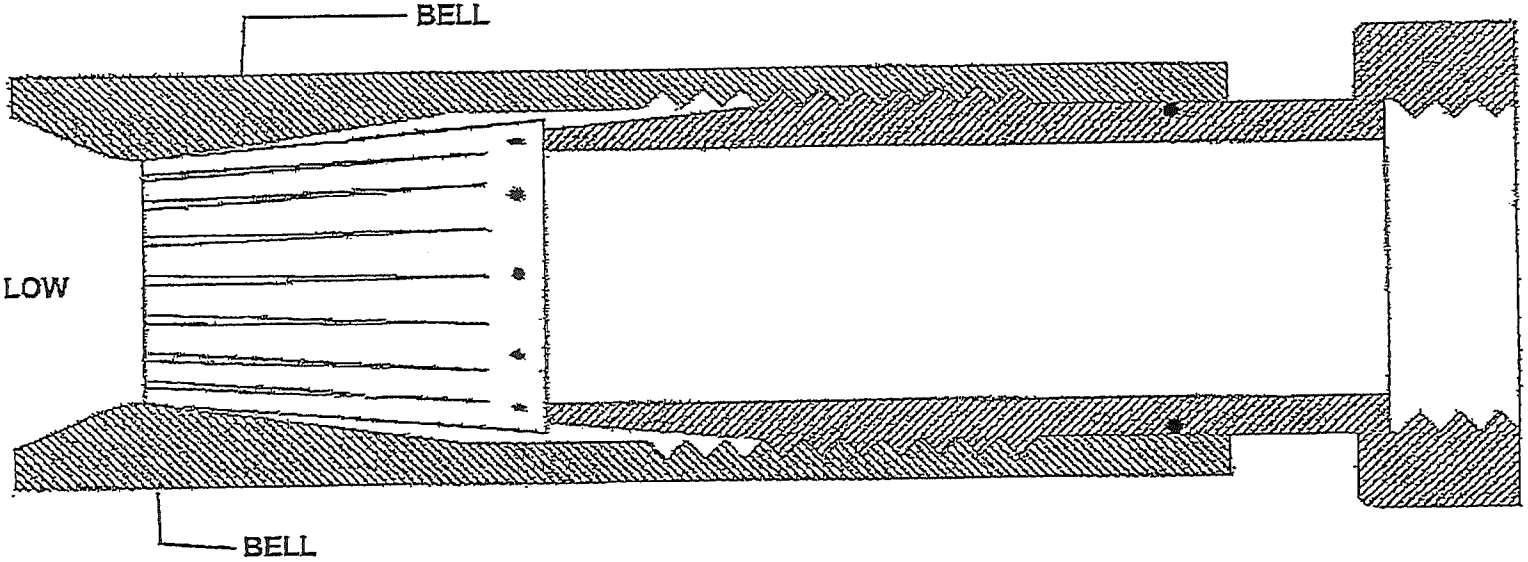
Figure 7:
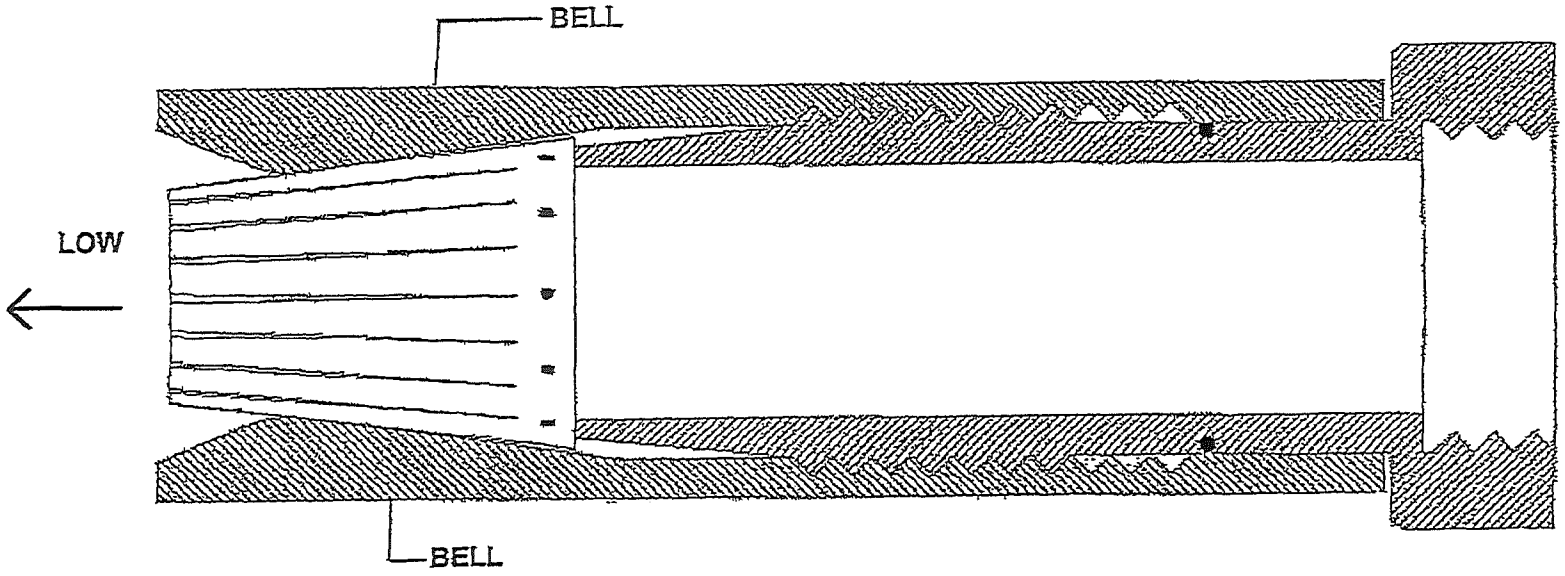

The throttle assembly can be bounded by a rotating outer body (bell; shown in FIGS. 6 and 7). This embodiment will cause the nozzle to operate as a selectable smooth bore. This will allow the nozzle operator to adjust the GPM of the nozzle within the limits of the available water supply.

In FIG. 6, the throttle assembly's discharge end (left end) is in its most open position. The exit orifice area is the greatest in this position. The supply water pressure exerts force along the assembly's ID. This force spreads the discharge end of the assembly against the ID of the bell, which limits the expansion of the throttle assembly. The bell is in its most forward position. If the throttle is "matched" then the throttle assembly will only expand if a nozzle inlet pressure is in excess of 60 psi. If the available water supply generates a nozzle inlet pressure less than 60 psi, the throttle assembly will not expand though the bell is rotated forward. This prohibits the firefighter from adversely impacting the reach and stream quality, if the bell is left full open when there is an insufficient water supply. With a sufficient water supply, a nozzle inlet pressure of 60 psi will be maintained. If the nozzle is purposefully not "matched" the firefighter will be able to increase the exit orifice and therefore the GPM whether or not the water supply can maintain a nozzle inlet pressure of 60 psi in the full open position. This is strictly a matter of preference for one type over another. Both types are possible with this one design.

In FIG. 7 the bell has been rotated to its most aft position. The contoured ID of the bell forces the throttle to its most closed position. This minimized the area of the exit orifice. The flight of threads which mate the bell with the nozzle body are sufficiently fine to allow easy bell rotation yet sufficiently coarse to allow for quick bell movement.

This selectable smooth bore allows firefighters to manually maintain desired nozzle inlet pressure as well as a means to increase/decrease GPM (when desired) without stopping and changing tips.

Figure 8:
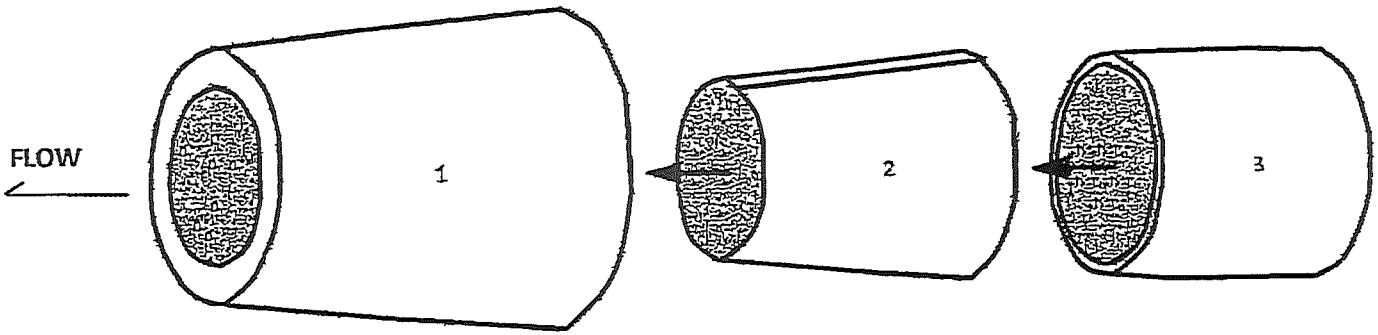

Alternate Automatic Smooth Bore:

FIG. 8 depicts a smooth bore nozzle that maintains a constant operating pressure despite an increase in GPM from the water supply (pump).

Figure 8A:
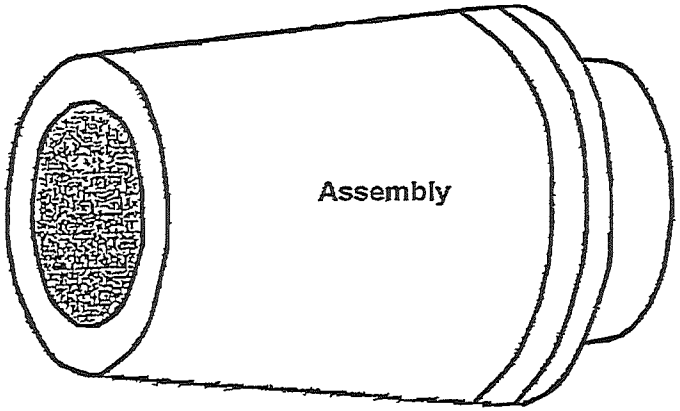
Figure 9:
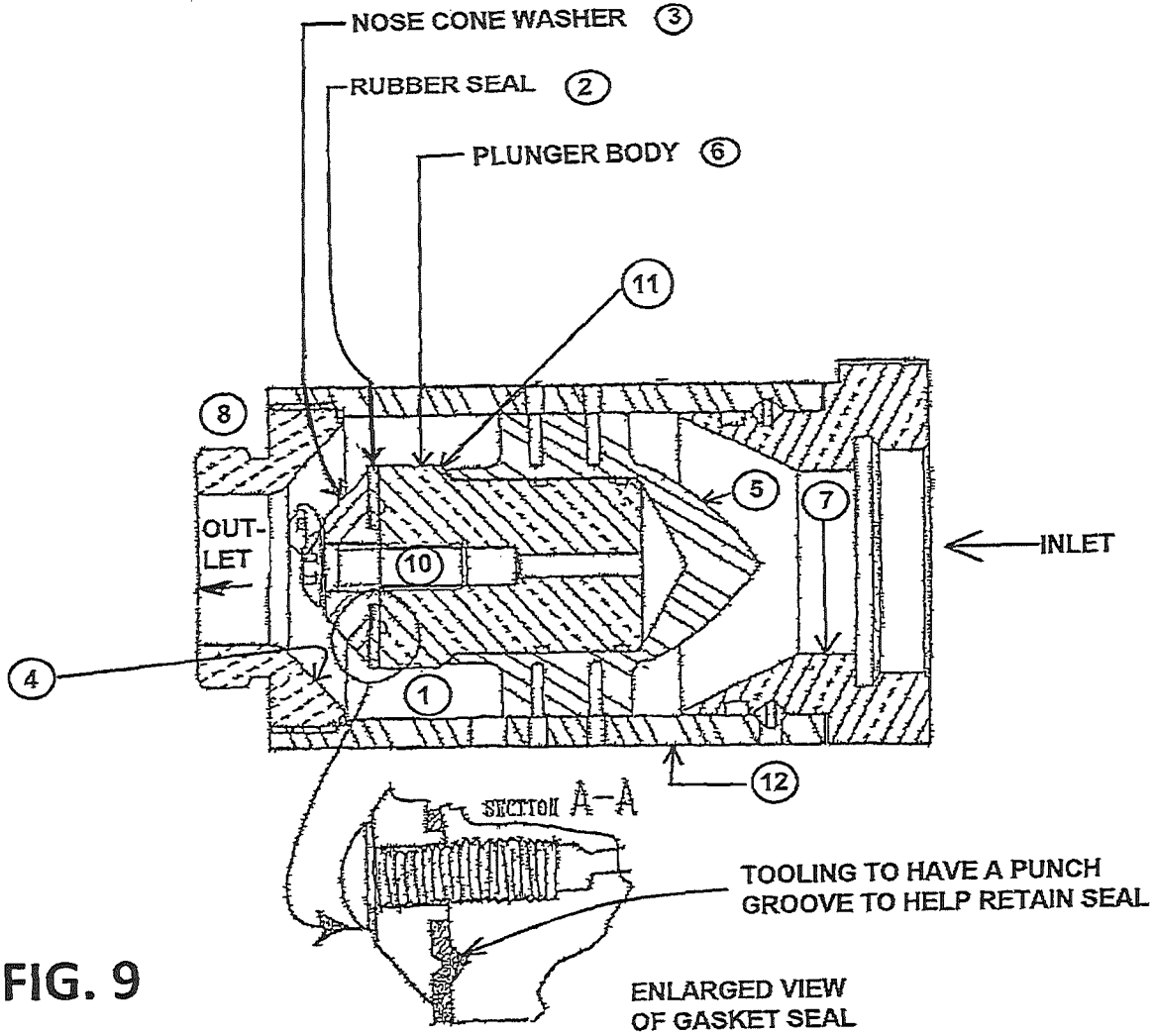
FIGS. 9-15 illustrate various views of different aspects and embodiments of a metering valve/nozzle.
Figure 10:
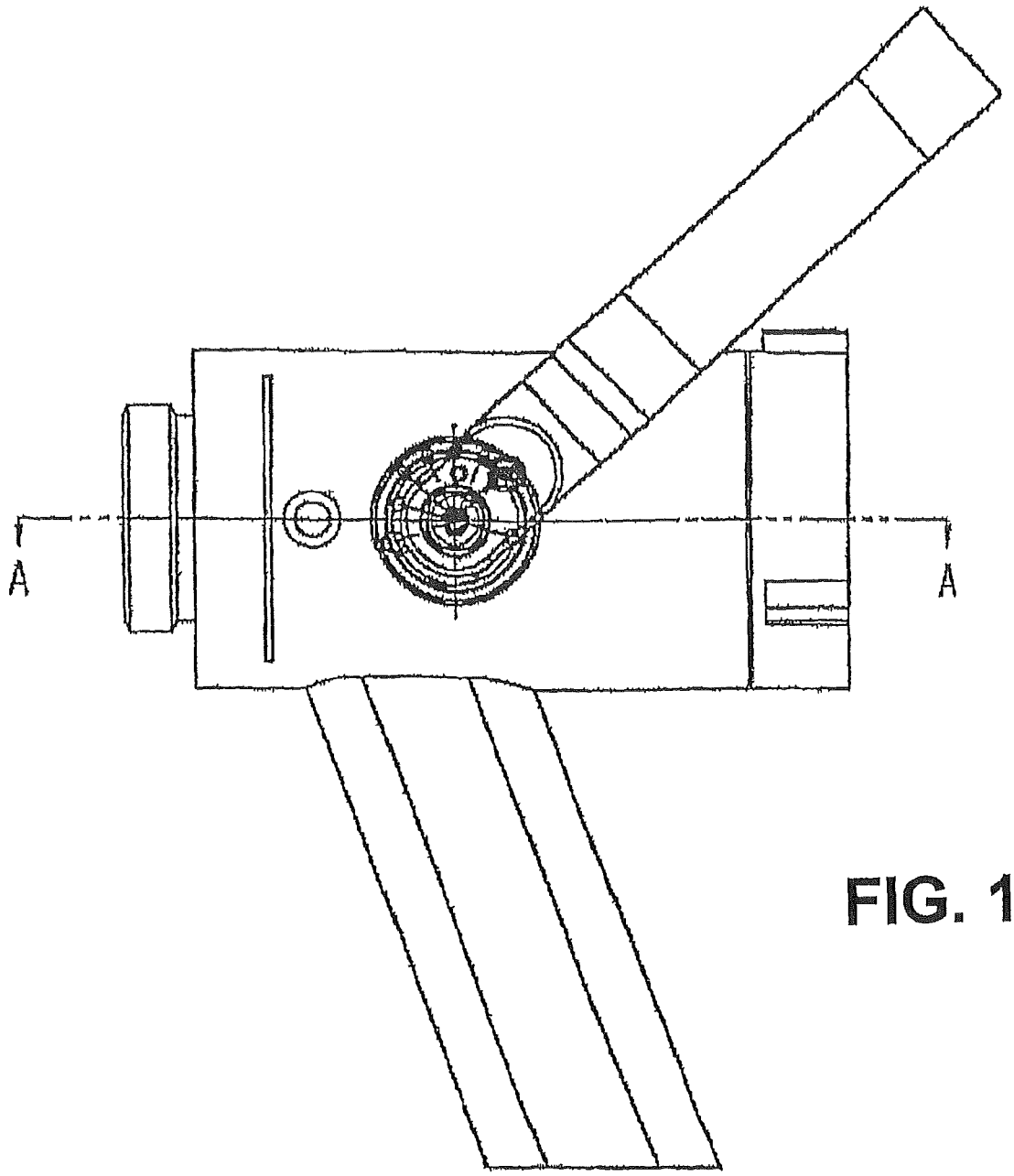
Figure 11:
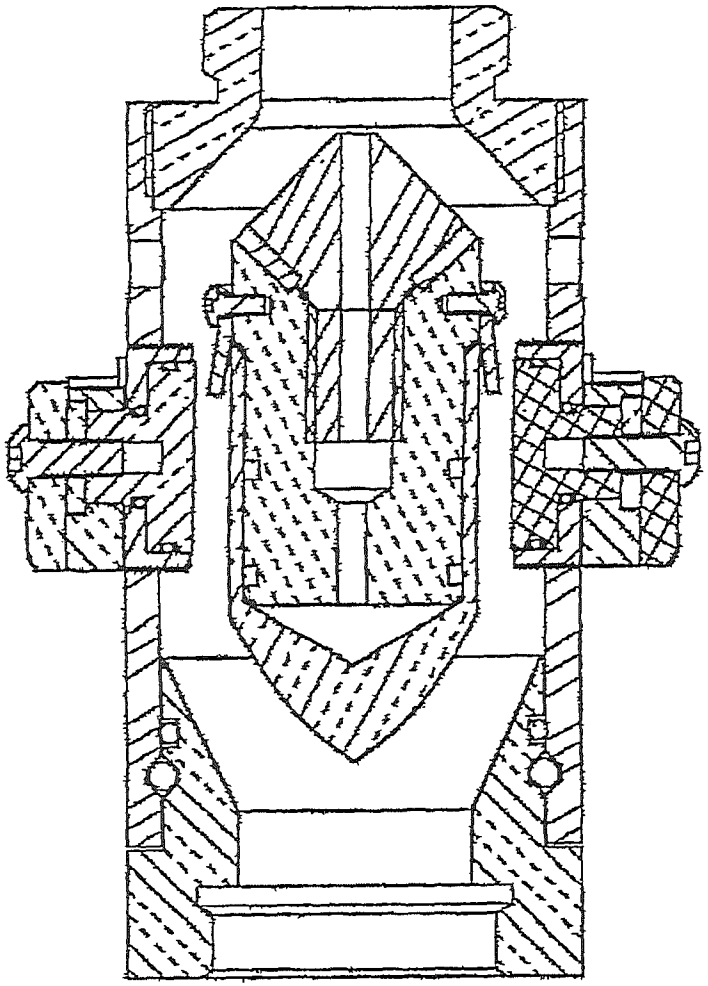
Figure 12:
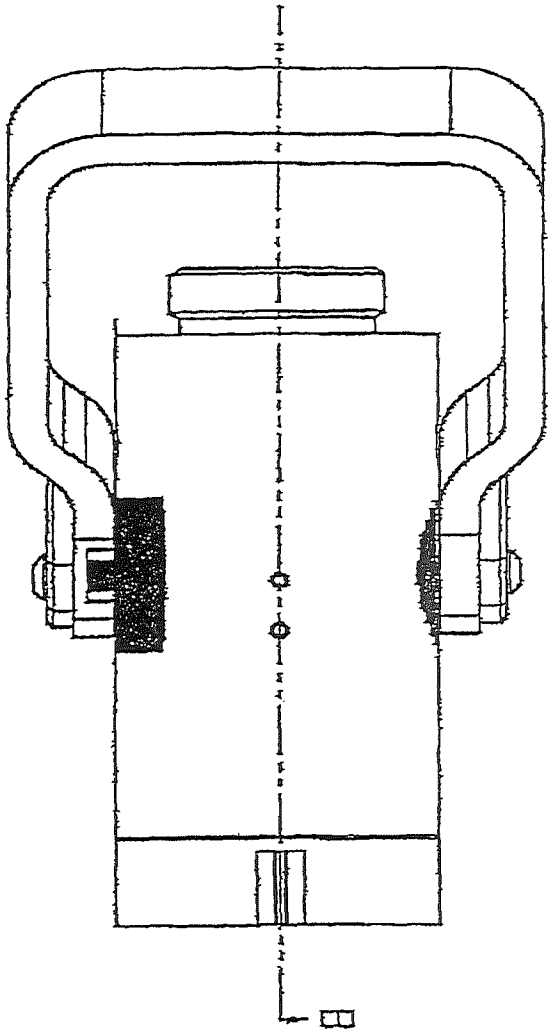
Figure 13:
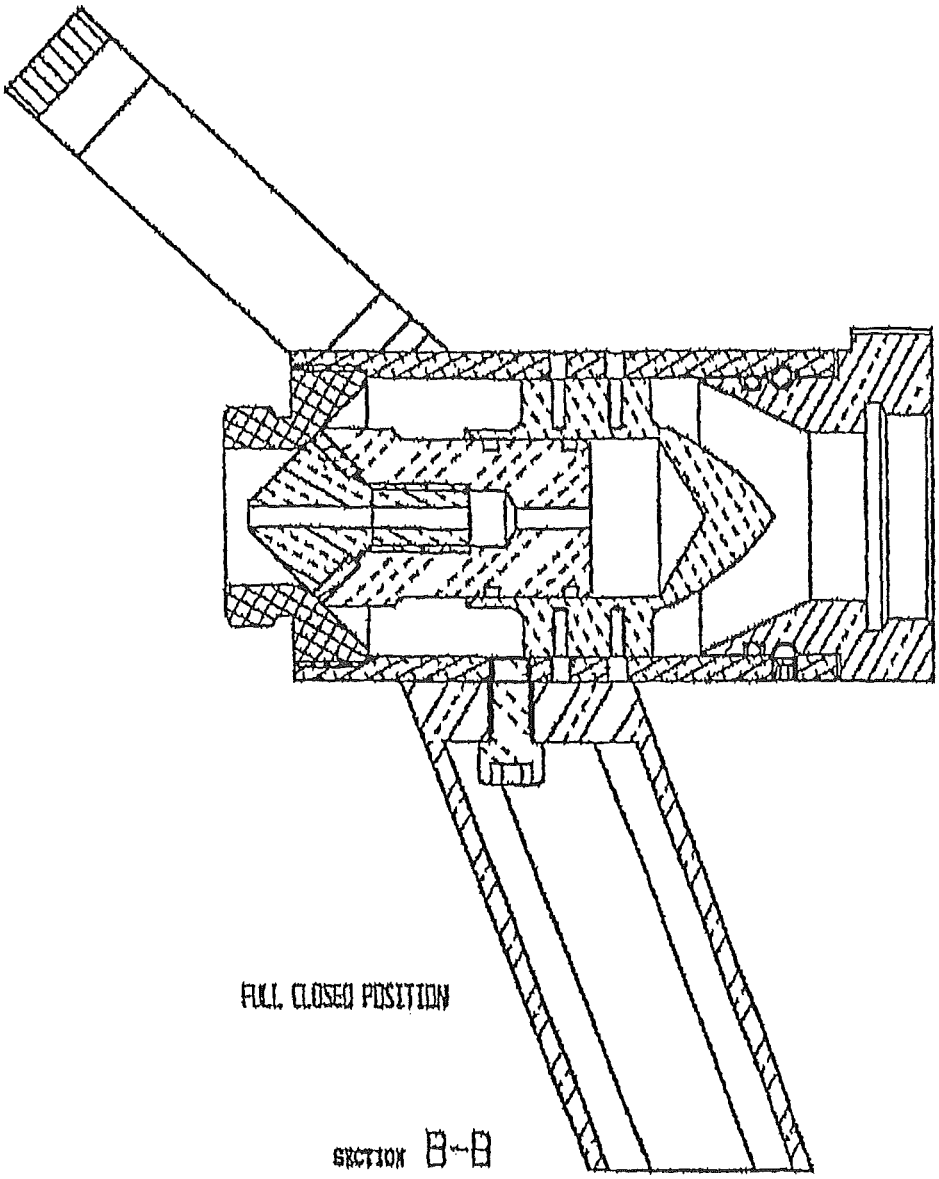
Figure 14:
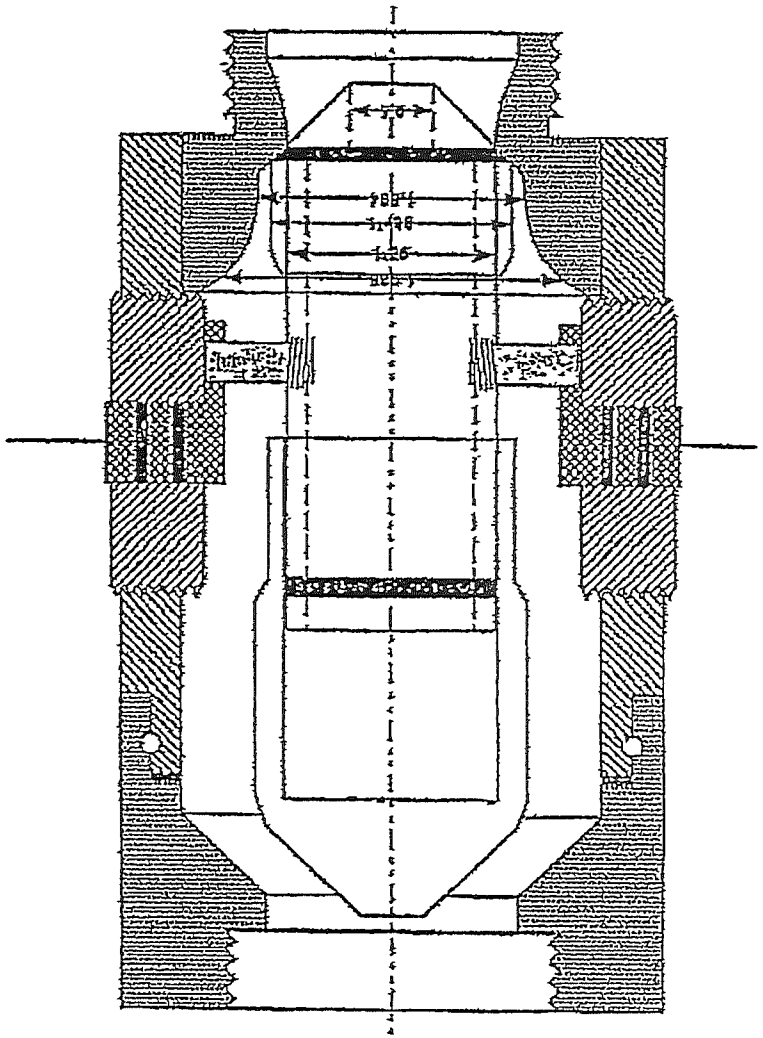
Figure 15:
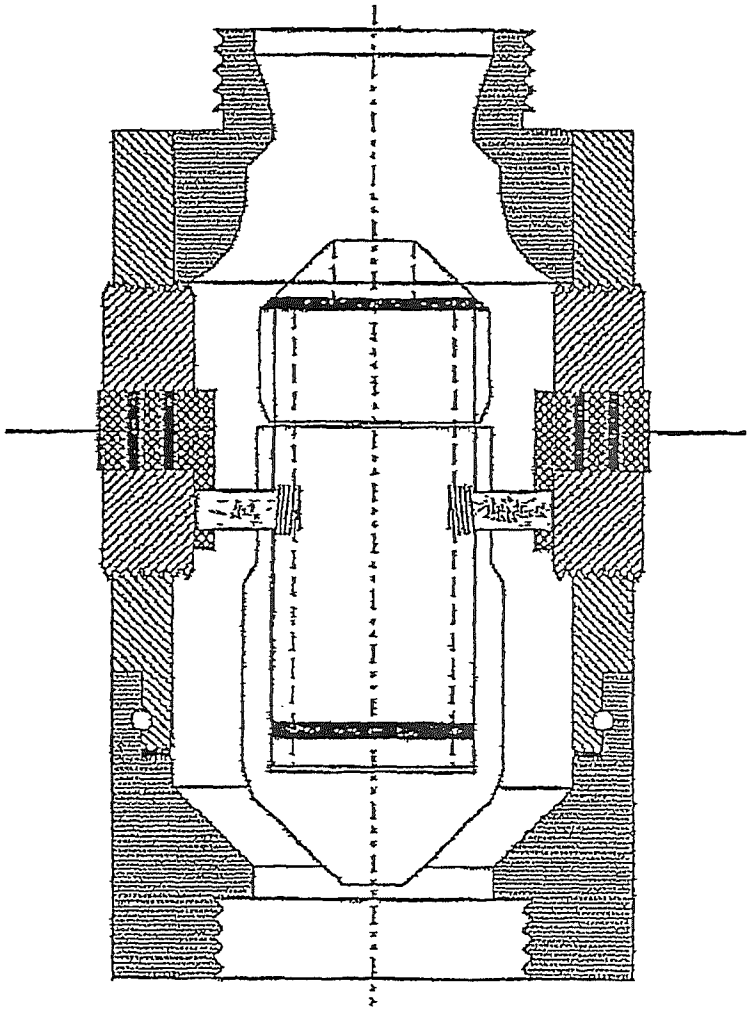

Component 1 is an elastic, water impervious material such as rubber. Component 2 is a rigid, springy, non-rusting material such as stainless spring steel. Component 3 is a rigid, non-rusting member suitably adapted for connection (usually threaded) to a hose (water source). Components 2 and 3 are rigidly connected by a means such as welding to each other. They are then inserted into 1. A band is added to create a water-tight seal between 1 and the body of 3. This assembly is the automatic smooth bore. The right end (larger diameter) is the inlet. The left end (outlet) of the assembly remains able to expand due to the elasticity of component 1 and the ability of component 2 to uncoil. The force required for the outlet end to expand can be modified by many means, such as the wall thickness of components 1 and 2 and the individual properties of the selected materials. The assembled components of FIG. 8 are shown in FIG. 8*a*.

For the following example, the force required for the expansion of the outlet end will be a force equal to 60 psi at the inlet end of this nozzle. This inlet pressure is customary for smooth bore nozzles and will produce a solid, straight stream of sufficient reach. A pump at the other end of the hose will supply the water at variable GPM. The GPM of the pump is slowly raised until an inlet nozzle pressure of 60 psi is reached. This is the minimum operating GPM for the nozzle. From this point the pump will once again increase the GPM supply. This will cause the discharge end of the nozzle to expand, allow more GPM to be expelled and maintain the 60 psi nozzle inlet pressure equilibrium. By maintaining this operating pressure despite the increase in GPM, the nozzle reaction (force required to hold back the nozzle) is minimized compared to fixed discharge orifice smooth bore nozzles. Also the reach and stream quality remain unchanged.

In a separate embodiment, a metering valve invention is described. The text pertaining to the metering valve corresponds to illustrations provided FIGS. 9-15. A prior art design has water flowing through the interior of a sliding tube and then around a rigidly mounted, solid sealing surface down the middle of the waterway. This means that water first starts down the center of the waterway and then is moved to the perimeter of the waterway. The present embodiment of the invention operates just the opposite. Water starts its journey by moving around a rigidly mounted body in the center of the waterway and then is allowed to flow down the center of the waterway. This allows this valve to be used with smooth bore nozzles and still get a good stream quality.

Smooth bore nozzles are very susceptible to poor flow quality due to obstructions in the middle of the waterway. By leaving the water in the center of the waterway, once past the valve, one embodiment of the current invention produces acceptable stream quality with smooth bores. In comparison, a prior art design leaves an object in the middle of the waterway once the valve is past and therefore upsets the stream quality more for smooth bores.

Automatic nozzles have a spring loaded baffle at the exit end of the nozzle. This baffle is spring-biased to keep the exit orifice minimized. The baffle moves outward in reaction to increase in upstream pressure, thereby increasing the area of the exit orifice and allowing more water to be expelled thus maintaining near constant pressure upstream. This device in cooperation with the slider valve allows the nozzle operator to control the GPM rate. The operator opens up the valve to allow the desired rate of flow to pass. The baffle opens in response to this volume/pressure relationship to maintain pressure and therefore stream quality. Automatic nozzles, unlike smooth bores are not affected by components in the center of the waterway such as the baffle.

One embodiment of the metering valve invention can be used on selectable and fixed nozzles. Selectable GPM nozzles rely on a separate manual control for increasing/decreasing exit orifice area to regulate the flow and a separate ball valve to turn on/off the nozzle. The fixed nozzle has just one exit orifice area so GPM will be determined by supply pressure only. If these style tips were connected to the metering valve, they would achieve easier flow regulation (flow regulation performed by the nozzle operator with just one control, the handle of the valve, and not the separate control ring of the selectable types or the pumper operator in the case of the fixed type).

Referring now to FIGS. 9-15, the following numbers refer to reference numerals shown on the figures:

1. This is the shoulder of the plunger body where mechanical linkage (not shown) is affixed. This linkage is connected to the manual handle operation in a way identical to that of the handle operation of the "twin tip". Moving the handle forward moves the plunger body forward. This direction of travel will decrease the amount of flow and the opposite direction of travel increases the GPM.

2. This creates the seal against the sealing surface (4).

3. The nose cone washer minimizes the turbulence of the flowing water as it returns to the center of the waterway. The distance between it and sealing surface (4), in cooperation with the available water pressure defines the GPM rate.

4. Sealing surface. See 2 and 3.

5. Receiver for the plunger body which is rigidly mounted to the ID of the main body (12). By being rigidly mounted it prohibits movement that would otherwise be caused by the rushing water in the flow condition. The upstream surface of the receiver is streamline to avoid turbulence and direct water around itself and the plunger body.

6. Plunger body moves in and out of (5). The shoulder (1) of this body is purposely raised. This raised section allows the water pressure to push tight against the seal and prohibit leaks in the no-flow condition. The plunger body has one or two (two are shown) o-rings to create a watertight seal between itself and (5). This is necessary in the off position.

7. Female threads which connect to the hose (shown as part of a free swivel for convenience of assembly).

8. Male treads to connect to the nozzle tip (smooth bore, automatic, selectable or fixed).

9. Bolt to hold (3), (2) and (6) firmly together. This bolt has a hole (10) right down the middle of it.

10. Hole down the middle (9), (3), (2), and (6). This hole is necessary to avoid a vacuum from being created between (5) and (6) when moving from the open position to the closed position.

11. This raised shoulder of (6) is made streamline so as not to be pushed closed by the moving water in the flowing water condition. In the full open position, where GPM and therefore frictional force of rushing water is greatest, the shoulder imbeds into (5) so as to reduce its upstream profile which of course reduces force of water friction. Further resistance to closing is created by the ball detents' friction of the manual handle (not shown) and the upstream surface of the receiver (5) which directs water around itself and the plunger body.

12. Main body.

What is claimed is:

1. An adjustable fluid nozzle, comprising:

a longitudinal nozzle body extending from an inlet to an outlet, such that said nozzle body defines a central axis, said nozzle body configured to receive pressurized fluid at said inlet and discharge the pressurized fluid at said outlet;

a flexible membrane comprised of an elastic water impervious material disposed within said longitudinal nozzle body and having an upstream end in fluid communication with said inlet of said nozzle body and a downstream end in fluid communication with said outlet of said nozzle body, said flexible membrane having a tapered profile and adapted to expand when said nozzle body receives the pressurized fluid, such that a downstream portion of said flexible membrane has a smaller diameter as compared to an upstream portion of said flexible membrane when said nozzle body is devoid of the pressurized fluid, said downstream portion being expandable when said nozzle body receives the pressurized fluid at said water inlet and being contractable when said nozzle body is devoid of the pressurized fluid, wherein said flexible membrane has a smooth inner surface;

wherein said nozzle body comprises a plurality of adjacent springy, non-rusting, members extending along the longitudinal central axis that contact said elastic water impervious material when said nozzle body receives pressurized fluid, said springy members having spaces therebetween and devoid of separate sealing elements connecting said springy members, said springy members adapted to form a tapered portion of said nozzle body, said tapered portion having a taper that matches the taper of said flexible membrane.

2. The adjustable nozzle of claim 1, wherein said adjacent, springy, non-rusting members comprise a plurality of triangular sections.

3. The adjustable nozzle of claim 1, wherein said adjacent springy, non-rusting members contact an exterior of said elastic water impervious material.

4. An adjustable fluid nozzle, comprising:

a nozzle body having a longitudinal central axis, said body having an inlet having an inner diameter and an outlet and;

a flow chamber between the inlet and the outlet;

an elastic water impervious material having an upstream end in fluid communication with said inlet of said nozzle body and a downstream end in fluid communication with said outlet of said nozzle body, said elastic water impervious material having a taper, said elastic water impervious material able to expand due to its elasticity when said nozzle body receives pressurized fluid;

a plurality of springy, non-rusting members adjacent to one another that define a tapered bore that has a taper that matches the taper of said elastic water impermeable material, said plurality of springy, non-rusting members in contact with at least a portion of said elastic water impervious material when said nozzle body receives the pressurized fluid, said plurality of springy, non-rusting members defining a plurality of gaps between one another; and an adjustable non-rusting member connected to said nozzle body that is adapted to expand or constrict a discharge of fluid when said nozzle body is adjusted in a fashion to either increase or decrease its inner diameter to enable the nozzle to operate as a selectable smooth bore.

5. The adjustable nozzle of claim 4, wherein the elastic water impervious material comprises rubber and said nozzle further comprises a member adapted for connection to a water supply.

6. The adjustable nozzle of claim 4, wherein said elastic water impervious material extends substantially from said inlet to said outlet of said nozzle body.

7. The adjustable nozzle of claim 4, wherein the plurality of springy, non-rusting members comprise adjacent triangular sections that contact an exterior portion of said elastic water impervious material.

8. The adjustable nozzle of claim 4, wherein said nozzle maintains a constant operating pressure despite an increase in gallons per minute from a fluid supply.

9. The adjustable nozzle of claim 4, wherein said plurality of springy, non-rusting members and said elastic water impervious material form a throttle assembly.

10. The adjustable nozzle of claim 4, wherein said fluid is supplied by a fluid source selected from the group consisting of a fire hydrant, a fire truck, and a submersible pump.

11. The adjustable nozzle of claim 4, wherein said nozzle further comprises a tip having an orifice and said tip is adjustable to vary the area of the tip's orifice.

12. The adjustable nozzle of claim 4, wherein said fluid comprises water.

13. The adjustable nozzle of claim 4, wherein said plurality of adjacent, springy, non-rusting members have spaces therebetween and are devoid of separate sealing elements connecting said adjacent, springy, non-rusting members.

14. An adjustable fluid nozzle comprising:

a nozzle body having a longitudinal central axis, said body having an inlet having an inner diameter and an outlet and further comprises a plurality of springy, non-rusting members that define a tapered bore, a fluid flow chamber between the inlet and the outlet;

an elastic water impervious material in fluid communication with said inlet and in contact with said plurality of springy, non-rusting members, said elastic water impervious material being tapered and able to expand due to its elasticity;

wherein said springy, non-rusting members extend along the longitudinal central axis and contact said elastic water impervious material when said nozzle body receives pressurized fluid, said springy members defining a plurality of gaps between one another;

an adjustable non-rusting member connected to said nozzle body that is adapted to expand or constrict a discharge of fluid when said nozzle body is adjusted in a fashion to either increase or decrease its inner diameter to enable the nozzle to operate as a selectable smooth bore; and a member operably associated with said nozzle that is adapted for connection to a fluid supply.

15. The adjustable nozzle of claim 14, wherein said springy, non-rusting members comprise adjacent triangular sections that are movable to reduce the inner diameter of said nozzle body, said triangular sections comprised of stainless steel.

16. The adjustable nozzle of claim 14, wherein said springy, non-rusting members have spaces therebetween and are devoid of separate sealing elements connecting them.

17. The adjustable nozzle of claim 14, wherein the elastic water impervious material comprises rubber.

18. The adjustable nozzle of claim 14, wherein said elastic water impervious material extends from said inlet to said outlet of said nozzle body.

19. The adjustable nozzle of claim 14, wherein said nozzle body comprises a cylindrical body portion to which said adjustable non-rusting member is coupled, and a tapered body portion that extends from said cylindrical body portion to said outlet.

20. The adjustable nozzle of claim 14, wherein said nozzle maintains a constant operating pressure despite an increase in gallons per minute from a water supply.

* * * * *